United States Patent [19]

Tuck

[11] 4,342,550

[45] Aug. 3, 1982

[54] METHOD AND APPARATUS FOR THE REDUCTION OF FLARE SMOKE EMISSIONS

[75] Inventor: Lee Tuck, Sweeny, Tex.

[73] Assignee: Phillips Petroleum Company, Bartlesville, Okla.

[21] Appl. No.: 141,503

[22] Filed: Apr. 18, 1980

[51] Int. Cl.[3] ..... F23J 7/00; F23D 13/20; F23J 15/00

[52] U.S. Cl. ..... 431/4; 431/5; 431/90; 431/202

[58] Field of Search ..... 431/4, 5, 90, 202

[56] References Cited

U.S. PATENT DOCUMENTS 3,829,275 8/1974 Stranahan et al. ..... 431/90
4,094,632 6/1978 Reed et al. ..... 431/4

*Primary Examiner*—John J. Camby

[57] ABSTRACT

A method and apparatus for controlling the amount of smoke produced when flaring a combustible gas is disclosed. The invention employs steam which is also passed to the flare .

32 Claims, 3 Drawing Figures

METHOD AND APPARATUS FOR THE REDUCTION OF FLARE SMOKE EMISSIONS

BACKGROUND OF THE INVENTION

This invention relates to a method and an apparatus for reducing flare smoke emissions discharged to the atmosphere. In another aspect the invention relates to refinery relief systems in which a flare system is used. In still another aspect this invention relates to the proper operation of a flare system to protect the environment while being used to eliminate combustible waste gases.

It is common practice for refineries to collect combustible waste gas and to pass it to a flare system for burning. Refineries built to process combustible gases are constructed so that vessels used in the refining process are designed to withstand normal pressure variations during routine plant operations. However, to prevent the rupture of these vessels when operating conditions would result in pressures that exceed their design pressure limits, safety relief valves are placed on these vessels to vent the gases. These vented gases are passed to a flare system where the combustible gases are burned. A properly operated flare system protects the environment such as by eliminating the production of smoke while being used to safely and economically eliminate combustible waste gases.

While it is within the capability of one skilled in the art to design a flare that will burn combustible gases without producing appreciable amounts of smoke, such designs generally require that the amount and composition of the waste gases be reasonably constant, a requirement which is usually not practicable. In order to overcome the production of smoke when flaring combustible gases one rather common technique is to pass steam to the flare along with the combustible gases, however, this technique does not completely solve the smoke problem.

It is therefore an object of this invention to provide a method and an apparatus for the reduction of flare smoke emissions discharged to the atmosphere during the burning of combustible gases. Another object of this invention is to provide a method and an apparatus for the reduction of flare smoke emissions when steam is passed to the flare along with the combustible gases.

Other objects and advantages of the invention will be apparent from the foregoing brief description of the invention and the appended claims as well as from the detailed description of the invention as described herein.

STATEMENT OF THE INVENTION

In accordance with the present invention a combustible gas and steam are passed to a flare and steam is continued to be passed to the flare for a predetermined period of time after discontinuing the flow of combustible gas to the flare.

Further according to the invention the apparatus comprises means for passing a combustible gas to a flare, means for detecting the passing of the combustible gas to the flare, means for passing steam to the flare when it is detected that combustible gas is being passed to the flare and means for passing steam to the flare for a predetermined period of time after the combustible gas has stopped being passed to the flare.

DETAILED DESCRIPTION OF THE INVENTION

Figure 1:
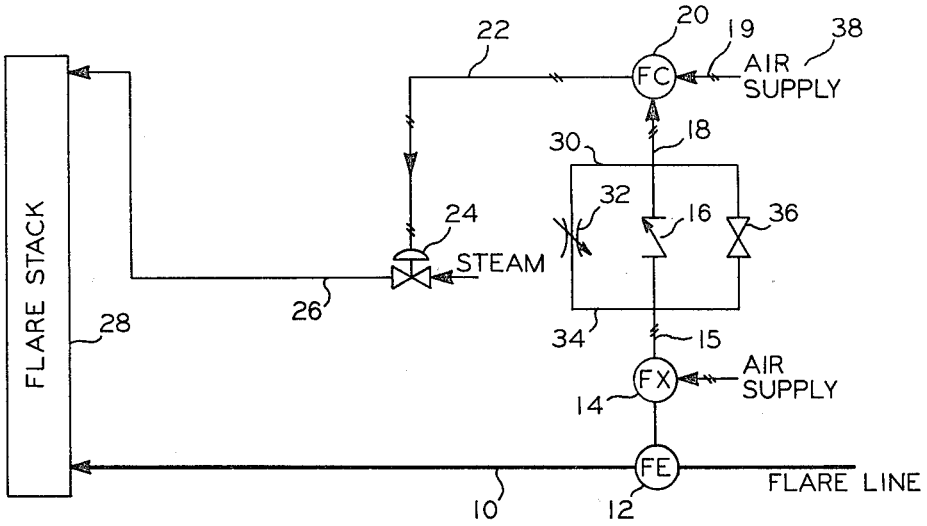
FIG. 1 is a diagram of an embodiment of a flare control system according to the invention.

Referring to FIG. 1, a combustible gas is passed through conduit 10 to a flare 28 where the combustible gas is burned. The passing of a combustible gas through conduit 10 is detected by measuring a first differential pressure using a pitot venturi 12 and transmitting the first differential pressure as a first signal by transmitter 14 through conduit 15, check valve 16 and conduit 18 to flow controller 20. A by-pass valve 36 is in parallel with check valve 16. A set point signal from a set point signal source 38 is transmitted via conduit 19 to flow controller 20. Flow controller 20 compares the set point signal with the first signal and transmits a steam flow control signal through conduit 22 to open steam flow control valve 24 which is located in steam line 26 which is attached to flare 28. Flow controller 20 as shown in this embodiment is a proportional-integral controller, thus where the first signal is greater than the set point signal, the steam flow control signal opens steam flow control valve 24 to the full open position, allowing steam to flow to flare 28. Flow controller 20 could also be a proportional position controller or a ratio controller, then in response to the first signal, the steam flow control signal opens steam flow control valve 24 in proportion to the magnitude of the first signal. The first signal terminates when the pitot venturi 12 stops detecting a first differential pressure.

In accordance with the invention a conduit 30 attached to conduit 18 connects a restrictor 32 to conduit 15 via conduit 34. Restrictor 32 permits the flow of the signal medium only in the opposite direction to that of check valve 16 and at an adjustable rate. Therefore, when the flow of combustible gases in conduit 10 is terminated as indicated by the first signal generated by transmitter 14 which measures the first pressure differential across the pitot venturi 12, restrictor 32 permits the first signal as seen by the flow controller 20 to slowly decrease by flowing through conduit 18, conduit 30, restrictor 32, conduit 34, conduit 15 and to bleed off to the atmosphere at transmitter 14. This maintains steam flow control valve 24 at least partially open for a predetermined period of time depending upon the opening of restrictor 32.

Figure 2:
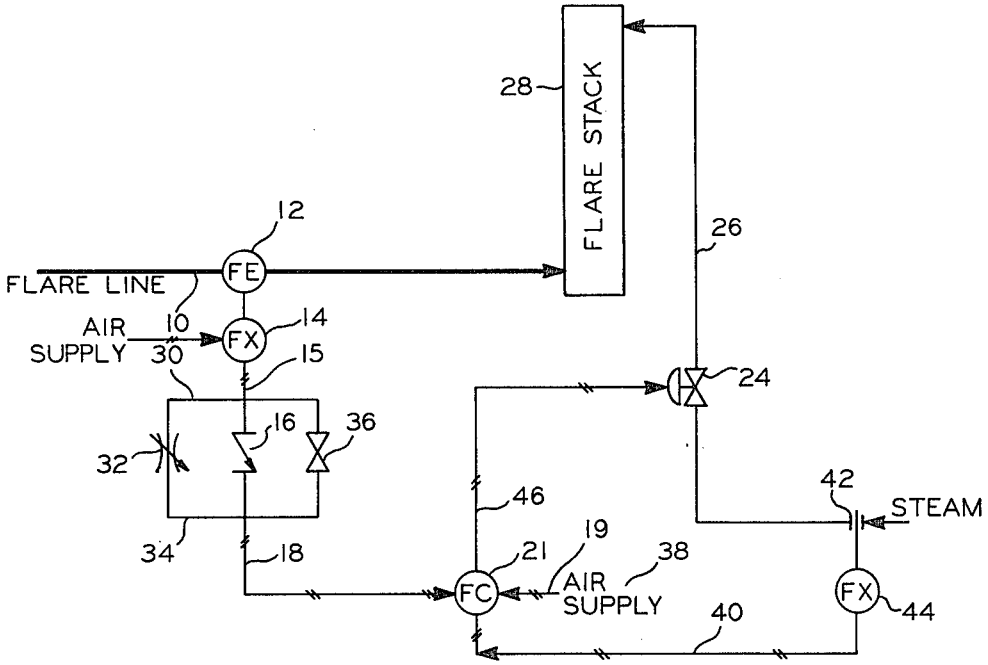
FIG. 2 is a diagram of an alternate embodiment of a flare control system according to the invention.

Referring to FIG. 2, a combustible gas is passed through conduit 10 to a flare 28 where the combustible gas is burned. Passing of a combustible gas through conduit 10 is detected by measuring a first differential pressure using a pitot venturi 12 and transmitting the first differential pressure as a first signal by transmitter 14 through conduit 15, check valve 16 and conduit 18 to flow controller 21. A by-pass valve 36 is in parallel with check valve 16. A set point signal from a set point signal source 38 is transmitted via conduit 19 to flow controller 21 and in this respect the process and apparatus as described thus far and shown in FIG. 2 is the same as that described in connection with FIG. 1.

Steam passes through conduit 40 to flow control valve 21 to flare 28. Steam passing through conduit 40 is monotored by measuring a second differential pressure using an orifice 42 and transmitting the second differential pressure as a second signal by transmitter 44, through conduit 40, to flow controller 21. Flow controller 21 compares the first signal, with the second signal and with the set point signal and transmits a steam adjustment signal through conduit 46, to open steam flow control valve 24, which is located in steam line 26 which is attached to flare 28.

In accordance with the invention a conduit 30 attached to conduit 16 connects a restrictor 32 to conduit 18 via conduit 34. Restrictor 32 permits the flow of the signal medium only in the opposite direction to that of check valve 16 and at an adjustable rate. Therefore when the flow of combustible gases through conduit 10 is terminated as indicated by the first signal generated by transmitter 14 which measures the first pressure differential across the pitot venturi 12, restrictor 32, permits the first signal as seen by flow controller 21 to slowly decrease by flowing through conduit 18, conduit 34, restrictor 32, conduit 30, conduit 15 and to bleed off to the atmosphere at transmitter 14. This maintains steam flow control valve 24 at least partially open for a predetermined period of time depending upon the opening of restrictor 32.

The advantage of the flare control system shown in FIG. 2 is that it allows the steam to flow to the flare at a rate which is consistently proportional to the magnitude of the first signal received by controller 17.

Figure 3:
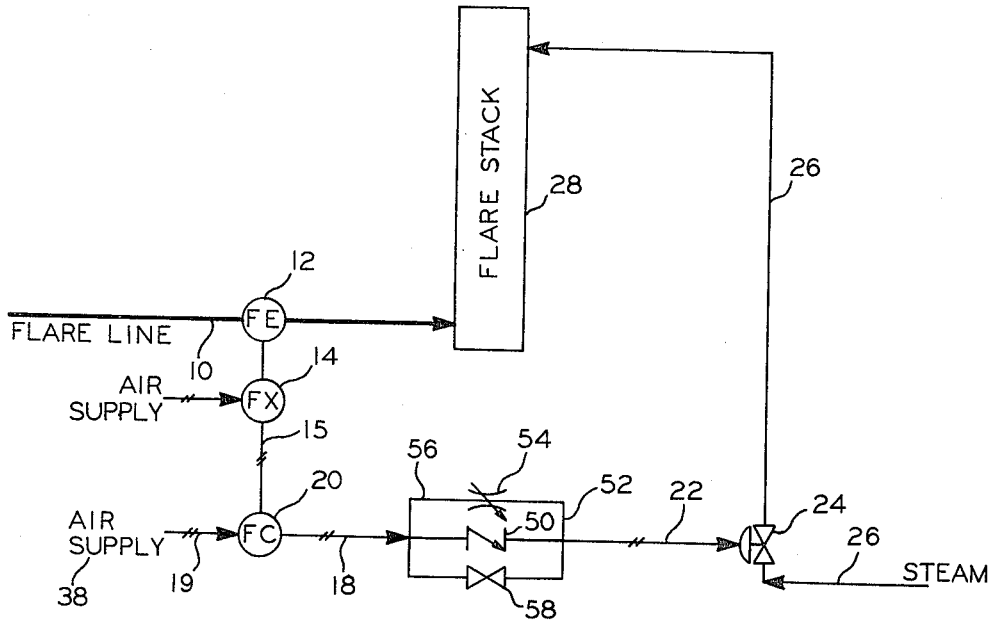
FIG. 3 is a diagram of another alternate embodiment of a flare control system according to the invention.

Referring to FIG. 3, a combustible gas is passed through conduit 10 to a flare 28 where the combustible gas is burned. The passing of a combustible gas through conduit 10 is detected by measuring a first differential pressure using a pitot venturi 12 and transmitting the first differential pressure as a first signal by transmitter 14 through conduit 15 to flow controller 20. A by-pass valve 58 is in parallel with check valve 58. A set point signal from a set point signal souce 38 is transmitted via conduit 19 to flow controller 20. Flow controller 20 compares the set point signal with the first signal and transmits a steam flow control signal through conduit 18, through check valve 50 and conduit 22, to open steam flow control valve 24 located in steam line 26 which is attached to flare 28. Flow controller 20 is a proportional-integral controller, thus, when the first signal is greater than set point signal, steam flow control means signal opens steam flow control valve 24 to the full open position, allowing steam to flow to flare 28. Flow controller 20 could also be a proportional position controller or a ratio controller, then, in response to the first signal, steam flow control means opens steam flow control valve 24 in proportion to the magnitude of the first signal.

In accordance with the invention a conduit 52 attached to conduit 22 connects a restrictor 54 to conduit 18 via conduit 56. Restrictor 54 permits the flow of a signal medium only in the opposite direction to that of check valve 50 and at an adjustable rate. Therefore when the flow of combustible gases through conduit 10 is terminated as indicated by the first signal generated by transmitter 14 which measures the first pressure differential across the pitot venturi 12, restrictor 54, permits the first signal as seen by flow controller 20 to slowly decrease by flowing through conduit 22, conduit 52, adjustable restrictor 54, conduit 56, conduit 18 flow controller 20, conduit 15 and to bleed off to the atmosphere at transmitter 14. This maintains steam flow control valve 24 at least partially open for a predetermined period of time depending upon the opening of restrictor 54.

The rate of steam passed to the flare depends on the identity of the combustible gas being burned. Unsaturated combustible gases require a greater amount of steam to obtain complete burning efficiency. Generally the rate of steam for unsaturated hydrocarbon combustible gases is within the range of 0.9 pounds to 1.3 pounds of steam per pound of combustible gas and for unsaturated hydrocarbon combustible gases is within the range of 0.3 pounds to 0.8 pounds of steam per pound of combustible gas.

The restrictor can be adjusted for any predetermined period of time. Generally, the restrictor is adjusted for a predetermined period of time of from about 15 seconds to about 3 minutes but more often the predetermined period of time is from about 30 seconds to about one minute.

In a specific example of the invention, an embodiment as shown in FIG. 1 was employed to flare combustible gases comprising hydrogen, methane, ethane, ethylene, propane and propylene. The steam employed was saturated steam and the steam rate was 0.4 pounds of steam per pound of combustible gas. The means employed for detecting the passing of combustible gases to the flare was a pitot venturi No. 88S 79 manufactured by the Taylor Instruments Company, Rochester, N.Y. The differential pressure detected by the pitot venturi in conjunction with a Foxboro differential pressure transmitter Model 15A1, manufactured by the Foxboro Instrument Company, Foxboro, Mass. was transmitted to a Foxboro Flow Controller Model 43AP through a check valve Model 1119B-2TP, manufactured by Circle Seal Controls located in Anaheim, Calif. The signal generated by the Foxboro Flow Controller Model 43AP was then transmitted to the steam control valve to open or close the valve. An adjustable restrictor Model No. C132AA, manufactured by Foxboro Instrument Company was connected on either side of the check valve to permit flow of the signal medium from the downstream side of the check valve to the upstream side of the check valve in order to permit exhausting the signal medium (air) to the atmosphere when the flow of combustible gases detected by the differential pressure transmitter and the pitot venturi is reduced or terminated. The adjustable restrictor was set to permit the flow of steam to the flare for a period of 60 seconds following the termination of passing combustible gases to the flare. Since the period of time beginning with the termination of flow of combustible gases to the flare and ending with the start of passing combustible gases to the flare was less than 60 seconds except occasionally, the practice of the present invention essentially eliminated the presence of smoke emanating from the flare at the beginning of each discharge of combustible gases to the flare without the necessity of passing steam to the flare on a continuous basis.

I claim:

1. A method comprising:

intermittently passing a combustible gas to a flare;

detecting the passing of said combustible gas to said flare;

generating a first signal representative of the passing of said combustible gas to said flare;

passing steam to said flare in response to said first signal and burning said combustible gas in said flare in the presence of said steam;

slowly decreasing the strength of said first signal when it is detected that said combustible gas is not being passed to said flare; and passing steam to said flare in response to said decreasing first signal after said combustible gas has stopped being passed to said flare.

2. A method as defined in claim 1 wherein the passing of said combustible gas to said flare is detected by measuring a first differential pressure of said combustible gas as it passes through a conduit to said flare.

3. A method as defined in claim 2 wherein said first signal is generated in response to the first differential pressure and steam is passed to said flare in response to said first signal.

4. A method as defined in claim 3 wherein a steam flow control means signal operates a steam flow control valve in response to the first signal.

5. A method as defined in claim 4 wherein a proportional rate of steam is passed to said flare in response to the first signal.

6. A method as defined in claim 5 wherein steam is passed to said flare in response to said decreasing first signal for a sufficient length of time to pass steam to said flare until said combustible gas is again passed to said flare.

7. A method as defined in claim 1 wherein the rate at which the steam is passed through a conduit to said flare is monitored by measuring a second differential pressure of said steam passing to said flare, generating a second signal in response to the second differential pressure and using the second signal to adjust the flow of steam to said flare.

8. A method as defined in claim 7 wherein a steam adjustment signal is generated in response to the first signal and the second signal.

9. A method as defined in claim 8 wherein steam is passed to said flare in response to the steam adjustment signal.

10. A method as defined in claim 9 wherein the steam is passed to said flare in response to said steam adjustment signal for a sufficient length of time to pass steam to said flare until said combustible gas is again passed to said flare.

11. A method as defined in claim 10 wherein the steam is passed to the flare for a period of time within the range of from 15 seconds to three minutes after the detection of the termination of passage of said combustible gas to said flare.

12. A method as defined in claim 11 wherein the steam is passed to the flare for a period of time within the range of from 30 seconds to one minute after the detection of the termination of passage of said combustible gas to said flare.

13. A method as defined in claim 1 wherein said combustible gas substantially comprises a hydrocarbon.

14. A method as defined in claim 13 wherein said combustible gas is selected from the group consisting of a saturated hydrocarbon, an unsaturated hydrocarbon and mixture thereof.

15. A method as defined in claim 13 or 14 wherein the molar ratio of said steam to said combustible gas is within the range of from 0.3 lbs. of steam per pound of combustible gas to 1.3 lbs. of steam per pound of combustible gas.

16. Apparatus comprising:

means for passing a combustible gas to a flare;

means for detecting the passing of said combustible gas to said flare and for producing a first signal representative of the passing of said combustible gas to said flare;

means for slowly decreasing the strength of said first signal when it is detected that said combustion gas is not being passed to said flare;

means for passing steam to said flare in response to said decreasing first signal; and means for passing steam to said flare in response to said decreasing first signal after said combustible gas has stopped being passed to said flare.

17. An apparatus as defined in claim 16 wherein a pitot ventri is used to detect the passing of said combustible gas through a conduit to said flare by measuring a differential pressure.

18. Apparatus as defined in claim 17 wherein a proportional-position controller generates a second signal in response to the first signal and the second signal is used to operate the means for passing steam to the flare.

19. Apparatus as defined in claim 17 wherein a ratio controller generates a second signal in response to the differential pressure and the second signal is used to operate the means for passing steam to the flare.

20. Apparatus as defined in claim 18 or 19 wherein the means for passing steam to the flare includes a steam flow controller that receives the second signal and generates a steam flow control signal to operate a steam flow control valve in response to the second signal.

21. Apparatus as defined in claim 20 further comprising an adjustable restrictor to slowly decrease the first signal as received by the steam flow controller after the flow of combustible gases to the flare has terminated.

22. The method of claim 1 which further comprises:

producing a setpoint signal;

comparing the first signal with the setpoint signal;

producing a steam flow control signal in response to a first signal which is greater than the setpoint signal; and passing steam to the flare in response to the steam flow control signal.

23. The method of claim 22 in which said first signal comprises an air stream and said means for decreasing the strength of said first signal comprises a flow restriction means and an air outlet downstream of said flow restriction means.

24. The method of claim 23 in which the amount of steam passed to the flare is proportional to the strength of the first signal.

25. Apparatus as defined in claim 16 further comprising:

means for determining a differential pressure of the steam to the flare and for generating a second signal representative of said pressure;

means for comparing the first and second signals and for producing a steam adjustment signal for controlling steam addition to the flare.

26. Apparatus according to claim 25 which further comprises means to generate a set point signal and means to compare the set point signal with the first signal.

27. A method comprising:

intermittently passing a combustible gas to a flare;

detecting the passing of said combustible gas to said flare;

passing steam to said flare when it is detected that said combustible gas is being passed to said flare and burning said combustible gas in said flare in the presence of said steam; and passing steam to said flare for a predetermined period of time after said combustible gas has stopped being passed to said flare;

wherein the rate at which the steam is passed through a conduit to said flare is monitored by measuring a second differential pressure of said steam passing to said flare, generating a second signal in response to the second differential pressure and using the second signal to adjust the flow of steam to said flare.

28. The method of claim 27 in which a steam adjustment signal is generated in response to the first signal and the second signal.

29. The method of claim 28 in which steam is passed to said flare in response to the steam adjustment signal.

30. The method of claim 29 in which the predetermined period of time for passing steam to said flare in response to said steam adjustment signal is of sufficient length to pass steam to said flare until said combustible gas is again passed to said flare.

31. The method of claim 30 in which the predetermined period of time is within the range of from 15 second to three minutes.

32. The method of claim 31 in which the predetermined period of time is within the range of from 30 seconds to one minute.

* * * * *